US010907434B2

(12) United States Patent
Abusomwan et al.

(10) Patent No.: US 10,907,434 B2
(45) Date of Patent: Feb. 2, 2021

(54) INTEGRATED FAIL-SAFE AND PUMP-THROUGH VALVE ARRANGEMENT

(71) Applicant: OneSubsea IP UK Limited, London (GB)

(72) Inventors: Uyiosa Anthony Abusomwan, Missouri City, TX (US); John Schoellmann, Houston, TX (US); Laurent Alteirac, Missouri City, TX (US); Amin Parnian, Houston, TX (US); Tej Bhadbhade, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 16/432,261

(22) Filed: Jun. 5, 2019

(65) Prior Publication Data

US 2019/0368297 A1 Dec. 5, 2019

Related U.S. Application Data

(60) Provisional application No. 62/680,671, filed on Jun. 5, 2018.

(51) Int. Cl.

| | |
|---|---|
| ***E21B 33/035*** | (2006.01) |
| ***E21B 33/06*** | (2006.01) |
| ***E21B 33/064*** | (2006.01) |
| ***E21B 34/04*** | (2006.01) |
| ***E21B 34/16*** | (2006.01) |

(52) U.S. Cl.

CPC ..... *E21B 33/0355* (2013.01); *E21B 33/06* (2013.01); *E21B 34/045* (2013.01); *E21B 34/16* (2013.01); *F15B 2211/212* (2013.01)

(58) Field of Classification Search

CPC .... E21B 33/0355; E21B 33/06; E21B 33/064; E21B 34/045; E21B 34/16

See application file for complete search history.

(56) References Cited

U.S. PATENT DOCUMENTS 4,325,434 A 4/1982 Roberts
4,421,174 A * 12/1983 McStravick ..... E21B 34/16 166/321

(Continued)

FOREIGN PATENT DOCUMENTS

| | | | |
|---|---|---|---|
| EP | 0896125 | A2 | 2/1999 |
| WO | 2014065995 | A1 | 5/2014 |
| WO | 2014153488 | A1 | 9/2014 |

OTHER PUBLICATIONS

Extended European Search Report issued in European Patent Appl. No. 19178534.4 dated Oct. 17, 2019; 9 pages.

*Primary Examiner* — Matthew R Buck
(74) *Attorney, Agent, or Firm* — Helene Raybaud

(57) ABSTRACT

A hydraulic arrangement for fail-safe and pump-through of a safety valve. The arrangement allows for compact actuation of a safety valve through accumulators. The arrangement supports automatic closure of the valve in the emergent circumstance of any loss of hydraulic control above the valve. Additionally, the arrangement also allows for a technique of re-opening the valve for long term killing of a well in direct response to the introduction of kill fluid without requiring any added complex interventional measures.

19 Claims, 5 Drawing Sheets

(56) References Cited

U.S. PATENT DOCUMENTS

| | | | | | |
|---|---|---|---|---|---|
| 4,880,060 | A * | 11/1989 | Schwendemann | E21B 34/045 | 166/336 |
| 5,890,698 | A * | 4/1999 | Domytrak | E21B 33/06 | 137/629 |
| 5,894,890 | A | 4/1999 | Garcia-Soule et al. | | |
| 6,164,619 | A * | 12/2000 | Van Winkle | E21B 33/062 | 137/112 |
| 7,624,792 | B2 * | 12/2009 | Wright | E21B 33/06 | 137/68.11 |
| 9,091,136 | B2 * | 7/2015 | Allensworth | E21B 34/063 | |
| 9,410,391 | B2 * | 8/2016 | Guven | E21B 29/04 | |
| 9,410,393 | B2 * | 8/2016 | Larson | E21B 33/061 | |
| 10,246,970 | B2 * | 4/2019 | Deacon | E21B 34/02 | |
| 10,316,603 | B2 * | 6/2019 | Rytlewski | E21B 17/20 | |
| 2007/0084607 | A1 | 4/2007 | Wright et al. | | |
| 2016/0281462 | A1 * | 9/2016 | Rytlewski | F16K 31/122 | |

* cited by examiner

INTEGRATED FAIL-SAFE AND PUMP-THROUGH VALVE ARRANGEMENT

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout the productive life of the well. That is to say, from a cost standpoint, an increased focus on ready access to well information and/or more efficient interventions have played key roles in maximizing overall returns from the completed well.

By the same token, added emphasis on operator safety may also play a critical role in maximizing returns. For example, ensuring safety over the course of various offshore operations may also ultimately improve returns. As such, a blowout preventor (BOP), subsurface safety valve, and other safety features are generally incorporated into hardware of the wellhead at the seabed. Thus, production and pressure related hazards may be dealt with at a safe location several hundred feet away from the offshore platform.

In most offshore circumstances, the noted hardware of the wellhead and other equipment is disposed within a tubular riser which provides cased access up to the offshore platform. Indeed, other lines and tubulars may run within the riser between the noted seabed equipment and the platform. For example, a landing string which provides well access to the newly drilled well below the well head will run within the riser along with a variety of hydraulic and other umbilicals.

One safety measure that may be incorporated into the landing string is a particularly tailored and located weakpoint. The weakpoint may be located in the vicinity of the BOP, uphole of the noted safety valve. Therefore, where excessive heave or movement of the offshore platform translates to excessive stress on the string, the string may be allowed to shear or break at the weakpoint. Thus, an uncontrolled breaking or cracking at an unknown location of the string may be avoided. Instead, a break at a known location may take place followed by directed closing of the safety valve therebelow. As a result, an unmitigated hazardous flow of hydrocarbon through the riser and to the platform floor may be avoided along with other potentially catastrophic occurrences.

As with other subsea hardware, over the years, efforts to render the safety valve modular and decrease its overall footprint have been undertaken. Thus, transport, installation time and other costs may be reduced. Of course, with a smaller package and footprint comes the inherent limitation on available modes of actuation. This may be of concern. For example, in certain situations, coiled tubing, wireline or other interventional access line may be disposed through the valve at the time the above tubular separation occurs. When this is the case, the valve may be obstructed and unable to close. Thus, hydrocarbons may continue to leak past the valve and travel up the annulus of the riser to the platform with potentially catastrophic consequences.

Of course, to prevent such hazardous obstructions, the valve may be configured to achieve a cut-through of any interventional access line in combination with closure. So, for example, an internal spring or other valve closure mechanism may be utilized which employs enough force to ensure a cut-through of any obstruction each time that the valve closes.

Unfortunately, where efforts have been undertaken to minimize the footprint of a modular safety valve, ensuring enough force to both close the safety valve and provide any necessary cutting, may be a challenge. A conventional spring-driven mechanical actuator would generally supply sufficient force. However, with the size of the assembly minimized, there may not be sufficient room for such an actuator.

Once more, even when the valve is safely closed to prevent a catastrophic event as described above, there remains the need to re-open the valve in order to complete well-killing operations. That is to say, merely closing a safety valve over an otherwise free-flowing well is insufficient for maintaining long-term control over the well. Rather, at some point in the near term, the need to open the valve, supply kill fluid and take other follow-on remedial measures is necessary. This means that there is the need for yet another actuator capable of providing sufficient force to overcome the force of the initial closing actuator. Conventionally speaking, this would mean including enough space at the assembly for yet another mechanical actuator.

Lower profile, cost-effective, modular safety valves have been developed over the years. However, as a practical matter, the ability to realize the full potential of such valves has been limited due to the required added footspace and design complexity to accommodate actuators with enough actuation forces and capable of providing both "fail-safe" and "pump-through" capabilities, simultaneously. Unfortunately, in many circumstances, these lower profile valves are not even utilized due to the inability to realize any substantial benefit. Instead, high cost, more conventional valve packages are employed.

SUMMARY

A fail-safe and pump-through valve arrangement is provided for maintaining well control of a well at an oilfield. The arrangement includes a valve to occupy one of an open position and a closed position in the well. Also included is a first accumulator for actuating the valve to the closed position and a second accumulator for actuating the valve to the open position. The second accumulator is responsive to both a dedicated hydraulic line to surface and a kill fluid through the well for the actuating of the valve to the open position.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments are described with reference to certain offshore oilfield applications. For example, certain types of subsea blowout isolation assemblies and operations are illustrated utilizing a fail-safe valve. Specifically, assemblies and operations with the isolation assembly disposed over a wellhead and accommodating a coiled tubing conveyance are shown. However, the assembly may be located at various positions, including within a more sophisticated blowout preventer, below the wellhead or elsewhere. Additionally, accommodated conveyances may be wireline, slickline and others. Regardless, so long as the assembly accommodates accumulators for opening, closing and pumping through the fail-safe valve, the profile may be kept to a minimum with appreciable benefit realized.

Figure 1:
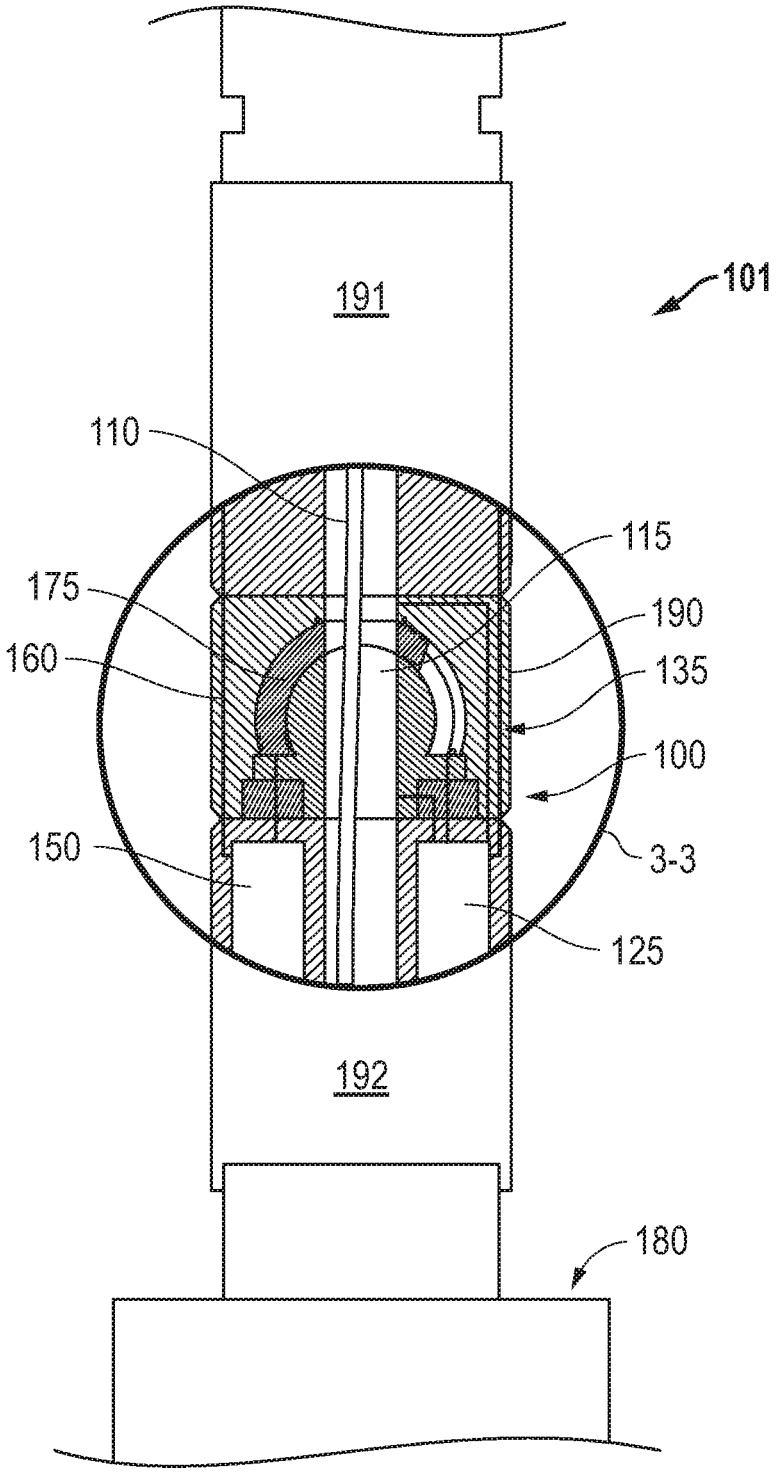
FIG. 1 is a side partially sectional view of a fail-safe valve arrangement incorporated into a blowout isolation assembly.
Figure 2:
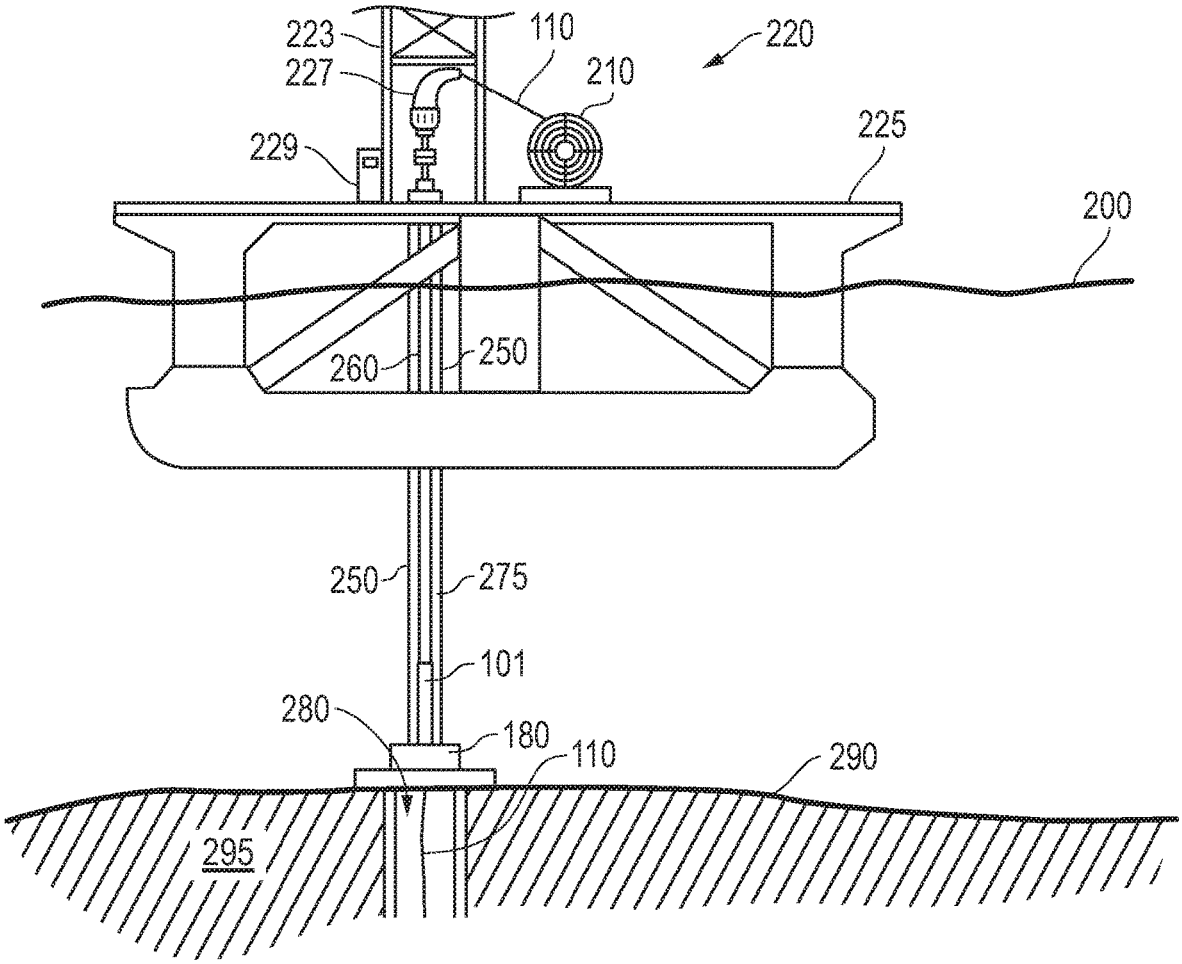
FIG. 2 is an overview of a subsea oilfield environment in which the blowout isolation assembly of FIG. 1 is utilized.

Referring now to FIG. 1, a side partially sectional view of a fail-safe valve arrangement 100 is shown. The arrangement 100 is incorporated into a blowout isolation assembly 101, for example, for use in a subsea well 280 environment as illustrated in FIG. 2. However, the arrangement 100 may be utilized in a variety of different operational locations, including at surface or even outside of the oilfield environment altogether. Regardless, notice that the assembly 101 is configured in a modular form with the valve arrangement 100 in a valve housing 190. The modular valve housing 190 illustrated accommodates a low profile arcuate, monolithic piston 175. This piston 175 is shown in the open position, allowing coiled tubing 110 access to a channel 115 of the assembly 101 for an interventional application in a well 280 (see FIG. 2). As suggested, the monolithic low-profile piston 175 helps facilitate this modular, user-friendly construction of the assembly 101.

In the embodiment shown, the overall user-friendly, modular construction of the assembly 101 is further aided by the manner in which the piston 175 is actuated. Specifically, hydraulic arrangements 125, 150 are provided within a modular accumulator housing 192 disposed adjacent the valve housing 190. That is, these are employed rather than utilizing larger physical spring-type actuators which would conventionally assure closure. As detailed further below, the close function hydraulic arrangement 150 provides sufficient force for closure even where closure requires that the piston 175 cut a conveyance such as the depicted coiled tubing 110. Once more, the open function hydraulic arrangement 125 supplies sufficient force for opening the piston 175 as illustrated while also supplying sufficient force for overcoming the close function hydraulic arrangement 150 for re-opening the piston 175 when the time comes.

In the embodiment shown, the assembly 101 is located at a well head 180. However, this hardware may be located in a variety of locations. Similarly, as noted above, the hydraulic arrangements 125, 150 are located in a dedicated accumulator housing 192. However, this is not required. For example, in one embodiment, the valve housing 190 may be enlarged to accommodate the hydraulic arrangements 125, 150 in addition to the associated hydraulics 135, 160 and the noted piston 175. Additionally, the modular concept may be continued into other adjacent equipment housings (e.g. 191). Thus, overall, the entire assembly 101 may be rendered in a cost-effective, user friendly form.

Continuing with reference to FIG. 1, the arrangement 100 is shown with the piston 175 in an open position, for example, to allow for the uptake of production fluids. As also suggested above, in the open position, access to the well 280 below may be available via coiled tubing 110 or other interventional tool (see FIG. 2).

With more specific reference to FIG. 2, an overview of a subsea oilfield environment is depicted in which the blowout isolation assembly 101 of FIG. 1 is utilized below a sea surface 200. As shown, the assembly 100 provides an anchored conduit emerging from the tubular string 260 leading to an offshore platform 220. Thus, securely controlled access to a cased well 280 below the well head 180 is provided. As described above, note the presence of coiled tubing 110 for an interventional application through the well 280 which traverses a formation 295 below a seabed 290.

Given that the tubular string 260 is structurally guided through a riser 250, added safety features are provided to prevent migration of hydrocarbons through the riser annulus 275 should there be a structural breakdown of the assembly 101. More specifically, as detailed above, where stresses result in controlled separation of a portion of the assembly 101, automatic action, in the form of valve closure with cutting of the coiled tubing 110, may be taken to prevent the noted migration. Thus, personnel at the floor 225 of the platform 220 may be spared a potentially catastrophic encounter with such an uncontrolled hydrocarbon fluid production.

Continuing with reference to FIG. 2, equipment disposed at the platform may include a supportive derrick 223 for any number of operations. Specifically, a conventional coiled tubing reel 210 and injector 227 are shown driving such an access line downhole. Additionally, a control unit 229 is shown which may serve as an operator interface for directing a variety of applications, including the noted coiled tubing operations or the normal opening and closing of the piston 175 of FIG. 1 as described above.

Figure 3A:
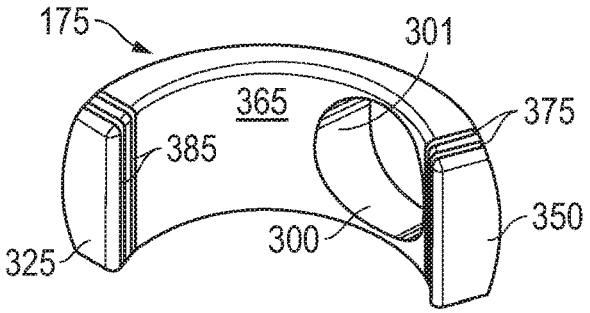
FIG. 3A is a perspective view of an embodiment of a monolithic piston utilized in the valve arrangement of FIG. 1.
Figure 3B:
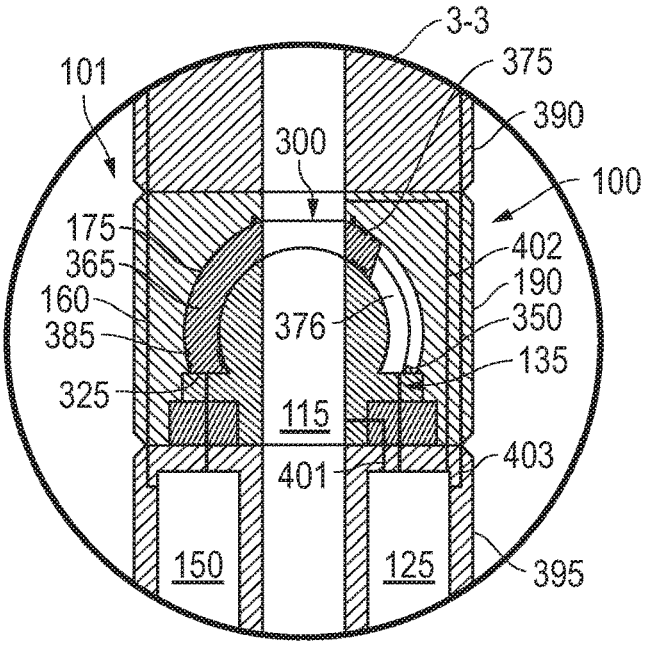
FIG. 3B is an enlarged cross-sectional view of the fail-safe valve arrangement taken from 3-3 of FIG. 1 with the piston of FIG. 3A in an open position.

Referring specifically now to FIG. 3A, a perspective view of an embodiment of a monolithic piston 175 is shown. This is the same piston embodiment illustrated in the valve arrangement 100 of FIG. 1. The monolithic, arcuate configuration of the piston 175 allows for the overall compact and modular nature of the valve arrangement 100 (e.g. see FIG. 3B). This piston 175 includes an opening 300 to align with the channel 115 through the entire assembly 101 when open as illustrated in FIGS. 1 and 3B. Alternatively, when closed, a body 365 of the piston aligns with the channel 115. Additionally, the opening 300 is defined by a cutting edge 301 that is tailored for cutting of a line, such as the coiled tubing 110 of FIGS. 1 and 2, should such be present in the channel 115 when the piston 175 is to be moved from an open position to a closed position.

Figure 3C:
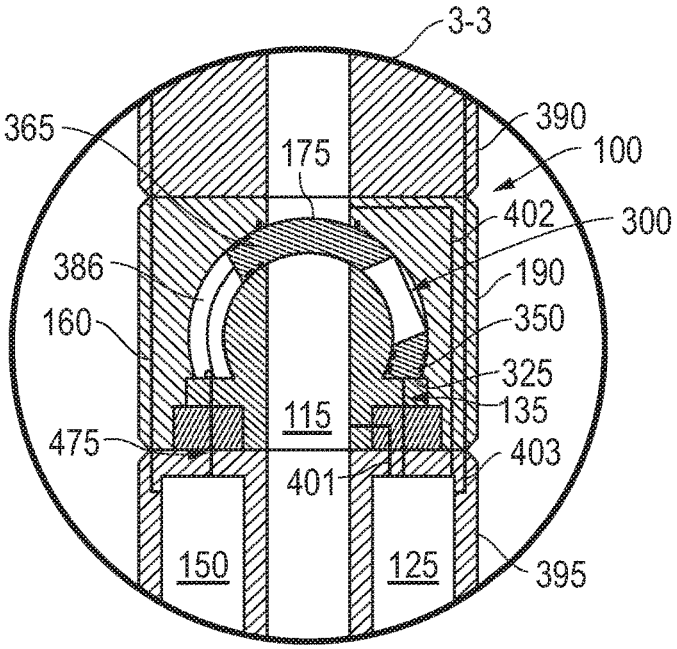
FIG. 3C is an enlarged cross-sectional view of the fail-safe valve arrangement taken from 3-3 of FIG. 1 with the piston of FIG. 3A in a closed position.

In the embodiment shown, moving from an open position to a closed position or vice versa is achieved by hydraulic interaction with ends 325, 350 of the piston 175. For example, sufficient hydraulic pressure applied to the "open" end 350 of the piston 175 would maintain or shift the piston 175 to an open position as illustrated in FIG. 3B. Alternatively, sufficient hydraulic pressure to the "close" end 325 of the piston 175 would maintain or shift the piston 175 to a closed position as illustrated in FIG. 3C. Notice the seals 325, 375 at either side of the piston 175. As hydraulic pressure is directed at the open end 350, the open side seals 375 may help to define an open chamber 376 as illustrated in FIG. 3B. By the same token, as hydraulic pressure is directed at the close end 325, the close end seals 385 may help define a close chamber 386 as illustrated in FIG. 3C. Thus, the opening and closing may take place in a hydraulically isolated and reliable manner.

Referring now to FIG. 3B, the maintaining or shifting of the piston 175 into the open position is discussed in greater detail. This includes opening the piston 175 for regular production or interventional operations. Additionally, as detailed further below, this also includes a uniquely beneficial technique for opening the piston 175 after it has been automatically closed in response to an emergency circumstance.

As shown in FIG. 3B, the assembly 101 and arrangement 100 include close hydraulics arrangement 150 which utilize a surface control line 160 that is capable of communication with a close accumulator 150A and the close chamber 386 (see FIG. 3C and FIG. 4A). The open hydraulics arrangement 125 also include a surface control line 403 that is capable of reaching an open accumulator 125A and the open chamber 376. However, the open hydraulic arrangement 125 also include dedicated lines 401, 402 that port to the channel 115 at locations below and above the piston 175, respectively. These added lines 401, 402 may be utilized to re-open the piston 175 as discussed further below, for example, following emergency closure and loss of control lines 160 and 403.

In absence of emergency closure or other circumstances likely to present large differential pressure in the channel 115, opening or maintaining the piston 175 in an open position as illustrated in FIG. 3B, is achieved through the surface control line 403. Specifically, an operator first bleeds of pressure in close control line 160, and directs pressure through the line 403 and to the open chamber 376 that is greater than any pressure in the close chamber 386 by way of the close accumulator 150A. This fairly straight forward pressurization control over opening the piston 175 may also be accompanied by charging of the open accumulator 125. That is, whenever the piston 175 is opened by the open surface control line 403, the opportunity is presented to ensure sufficient charging of the open accumulator 125A. This may be beneficial for later use should the surface control line 403 be impaired.

Referring now to FIG. 3C, an enlarged cross-sectional view of the fail-safe valve arrangement 100 taken from 3-3 of FIG. 1 is again depicted, this time with the piston 175 of FIG. 3A in a closed position. Specifically, the opening 300 is shifted to the right such that the channel 115 is closed off by the body 365 of the piston 175. Of course, this may be achieved in a similar fashion to the manner of opening the piston 175. That is, the close surface control line 160 may simply be utilized by the operator to direct greater pressure to the close chamber 386 while bleeding off the control line 403 of the open chamber 376 of FIG. 3B. Furthermore, the close control line 160 may be used to charge the close accumulator 150A to facilitate subsequent automatic closure should the circumstances arise. Indeed, at the outset of operations, the piston 175 may remain closed as the close accumulator 150 is charged.

Figure 4:
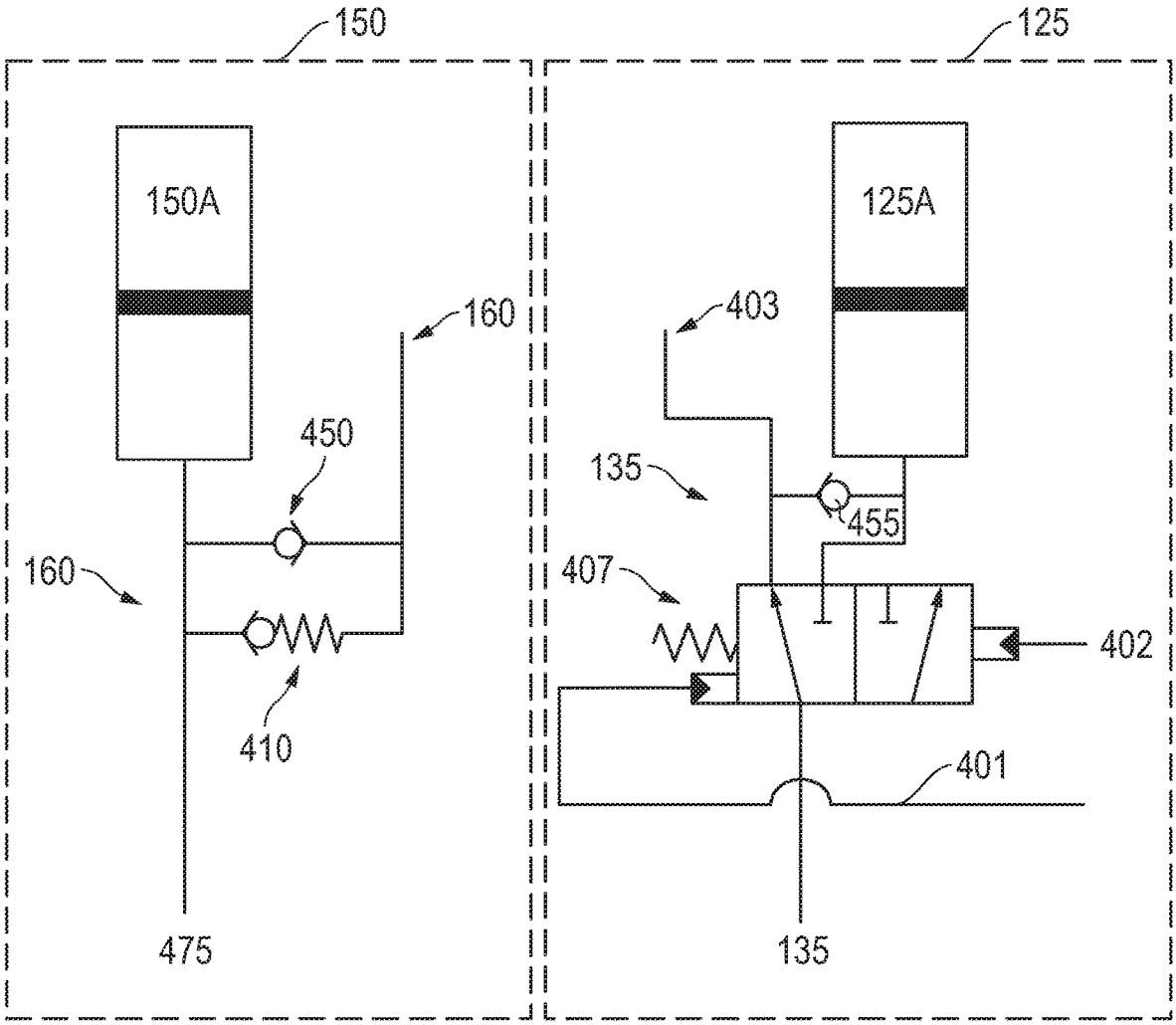
FIG. 4 is a schematic illustration of a multi-actuator layout for driving the opening, closing and pump-through of the piston in FIGS. 3A-3C.

Continuing with reference to FIG. 3C with added reference to FIG. 4, the scenario where well control is lost due to damage above the assembly 101 is considered as described above. With specific reference to FIG. 4, the close function hydraulics arrangement 150 may specifically include a line to surface 160 that normally runs through a check valve 450 and the close piston line 475 to the close chamber 386 while also providing capability to charge the close accumulator 150A as described above. However, with this line 160 severed, a drop in pressure at the accumulator would direct pressure from the accumulator 150A to the close chamber 386, thereby closing the piston 175 as depicted in FIG. 3C. Further, a check valve 450 and a spring assist check valve 410 may be used to help maintain the piston 175 in the closed position. However, under the right circumstances, this may be overcome to allow re-opening of the piston 175 while maintaining a consistent pre-charge of the close function arrangement 150 as described below.

Continuing now with reference to FIG. 3B again in light of FIG. 4, re-opening the piston 175 is considered. That is, following a period of time after loss of control lines, efforts to regain control over the well 280 may ensue (see FIG. 2). With the piston 175 safely holding off well pressure below, tubing may be attached to the assembly 101 for the delivery of well killing fluid to ultimately place the well in a more permanently secure state. With specific reference to FIG. 4, the surface control line 403 may normally be employed to direct pressure through a spool valve 407 and the close piston line 135 on to the open chamber 135 for opening of the piston 175 as illustrated in FIG. 3B. Additionally, as alluded to above, additional charge may be directed past a "open" check valve 455 to the open accumulator 125A. However, with loss of control through this line 403, alternate measures are taken when the time comes for re-opening of the piston 175.

The loss of control through line 403 in combination with the introduction of kill fluid into the channel 115 above the closed piston 175, means that from a differential standpoint, pressure is now introduced to the dedicated line above 402 the piston 175. Thus, increasing the kill fluid pressure to be sufficiently higher than the well pressure in line 401 below the piston 175 may ultimately slide the spool valve 407 to the left as illustrated in FIG. 4 such that the supported hydraulic path shifts into alignment with the open accumulator 125A. Therefore, the pressure in the open accumulator 125 need only overcome that of the close accumulator 150A and the spring assist check valve 410 in order to re-open the piston 175 and allow the influx of kill fluid for completed safe stabilization of the well 280 (see FIG. 2). Indeed, the charged open accumulator 125 may generally include a charge that is substantially greater than that of the close accumulator 150A, even accounting for the resistance of the spring assist check valve 140.

Figure 5:
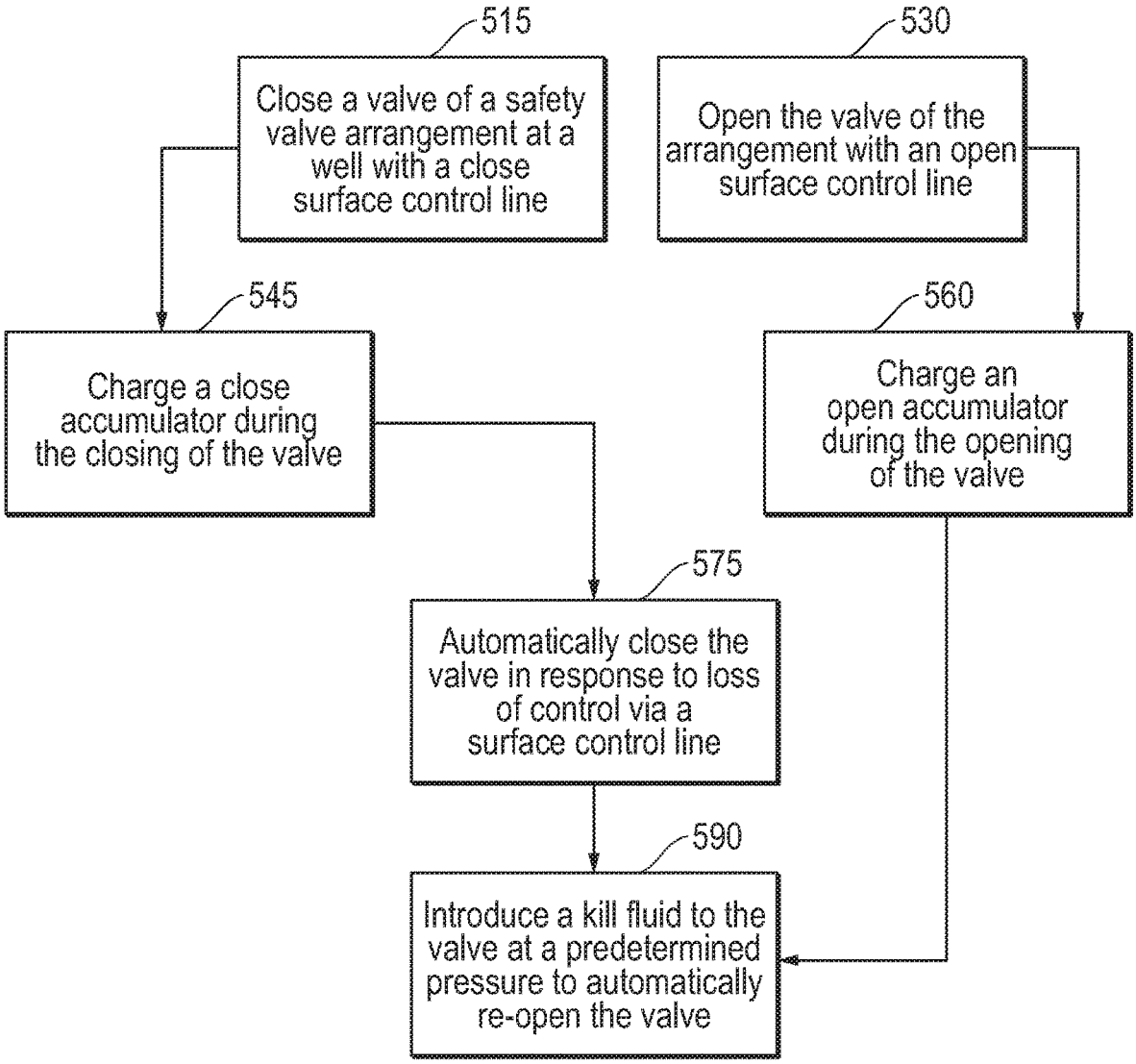
FIG. 5 is a flow-chart summarizing an embodiment of employing an actuator driven, low profile fail-save valve arrangement.

Referring now to FIG. 5, a flow-chart summarizing an embodiment of employing an accumulator driven, low profile, fail-safe and pump-through valve arrangement is presented. As indicated at 515 and 530, a valve such as the above described piston, may be opened and closed during normal operations via surface control lines. However, during these normal operations, dedicated accumulators may also be charged (see 545, 560). Thus, should an emergent circumstance arise where normal operations via the control lines is compromised, follow-on closing and re-opening of the valve may take place in a manner facilitated by these accumulators. Specifically, an automatic closure may follow the loss of control as indicated at 575. However, re-opening of the valve may also take place by way of introducing kill fluid as indicated 590. This re-opening in particular, is a uniquely advantageous capability that is rendered practical by the valve arrangement embodiments detailed herein.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A fail-safe valve arrangement at a well comprising:

a production fluid channel to accommodate fluid to and from a vicinity of the arrangement;

a safety valve to occupy one of an open position and a closed position in the fluid channel;

a first accumulator for actuating the valve to the closed position relative to the channel; and a second accumulator for actuating the valve to the open position, the valve openly responsive to both a dedicated hydraulic line to a surface location and the second accumulator via an influx of the fluid through the channel to the arrangement for providing fluid communication between the second accumulator and the valve.

2. The arrangement of claim 1 further comprising ports to provide fluid communication between the second accumulator and locations above and below the valve to facilitate the responsiveness by way of the second accumulator.

3. The arrangement of claim 1 further comprising a spool valve fluidly coupled to the safety valve to govern the open responsiveness.

4. The arrangement of claim 1 further comprising a check valve in a hydraulic path between the second accumulator and the safety valve.

5. The arrangement of claim 1 wherein the safety valve is closingly responsive to both a different dedicated hydraulic line to the surface location and the first accumulator via exposure to outside pressure from a break in the different dedicated hydraulic line.

6. The arrangement of claim 5 further comprising a check valve in the different dedicated hydraulic line.

7. The arrangement of claim 5 further comprising a spring assist check valve in a hydraulic path between the first accumulator and the safety valve.

8. A blowout isolation assembly at a well, the assembly including a fail-safe valve arrangement for maintaining well control over a production fluid channel of the well, the arrangement comprising:

a safety valve to occupy one of an open position and a closed position in the fluid channel, the safety valve openly responsive to a dedicated hydraulic line to a surface location and for automatically closing off the fluid channel in the well in response to a break in the dedicated hydraulic line; and an accumulator for actuating the safety valve to the open position in response to a shifted position of a spool valve as directed by kill fluid through the channel of the well to the arrangement for providing fluid communication between the accumulator and the safety valve.

9. The assembly of claim 8 in modular form wherein the safety valve is provided in a safety valve housing and the accumulator is provided in one of the safety valve housing and an adjacent housing.

10. The assembly of claim 8 wherein the well is a subsea well.

11. The assembly of claim 8 wherein the safety valve is a monolithic arcuate piston configured for cutting a conveyance in the well upon the closing.

12. The assembly of claim 11 wherein the conveyance is one of coiled tubing, wireline and slickline.

13. A method of re-opening a closed safety valve in a well, the method comprising:

opening the safety valve at a production fluid channel of the well with a dedicated hydraulic line to a surface location;

automatically closing the safety valve in response to a break in the dedicated line;

introducing a kill fluid into the channel of the well;

porting pressure of the fluid from the well at a location above the closed safety valve to a spool valve in fluid communication with an accumulator; and facilitating fluid communication between the accumulator and the safety valve for the re-opening via the spool valve in response to the porting of the pressure.

14. The method of claim 13 wherein the accumulator is a second accumulator, the method further comprising:

charging a first accumulator with a first pressure for closing the safety valve; and charging the second accumulator with a second pressure greater than the first pressure for the re-opening of the safety valve.

15. The method of claim 14 wherein the charging of the first accumulator comprises closing the safety valve with the dedicated hydraulic line and the charging of the second accumulator comprises opening the safety valve with another dedicated surface line.

16. The method of claim 15 wherein the charge of the second accumulator is to a pressure substantially greater than the charge to the first accumulator.

17. The method of claim 15 wherein the automatically closing comprises cutting a conveyance with the safety valve during the closing.

18. The method of claim 17 wherein the cutting is with a cutting edge of a monolithic arcuate piston serving as the safety valve.

19. The method of claim 18 wherein the safety valve is accommodated by a modular housing.

* * * * *